United States Patent [19]

Sasaki et al.

[11] Patent Number: 5,076,250

[45] Date of Patent: Dec. 31, 1991

[54] ENGINE SHUT-DOWN DEVICE

[75] Inventors: Asao Sasaki, Chiba; Yosuke Kubota, Tokyo, both of Japan

[73] Assignee: Fuji Jukogyo Kabushiki Kaisha, Tokyo, Japan

[21] Appl. No.: 527,832

[22] Filed: May 24, 1990

[30] Foreign Application Priority Data

May 26, 1989 [JP] Japan ..... 1-134285

[51] Int. Cl.[5] ..... F02P 1/08; F02P 11/02

[52] U.S. Cl. ..... 123/630; 123/149 R; 123/198 DC

[58] Field of Search ..... 123/630, 198 DC, 149 R, 123/149 A, 149 D

[56] References Cited

U.S. PATENT DOCUMENTS

| | | | |
|---|---|---|---|
| 3,116,729 | 1/1964 | Crowe | 123/198 DC |
| 3,726,265 | 4/1973 | Howard | 123/198 DC |
| 4,034,732 | 7/1977 | Van Burkleo | 123/630 |
| 4,193,385 | 3/1980 | Katsumata et al. | 123/630 |
| 4,369,745 | 1/1983 | Howard | 123/630 |

FOREIGN PATENT DOCUMENTS

| | | | |
|---|---|---|---|
| 55-148969 | 11/1980 | Japan | 123/198 DC |
| 57-200671 | 12/1982 | Japan | 123/630 |
| 59-32675 | 2/1984 | Japan | 123/198 DC |
| 59-173564 | 10/1984 | Japan | 123/198 DC |

*Primary Examiner*—Andrew M. Dolinar

*Attorney, Agent, or Firm*—Beveridge, DeGrandi & Weilacher

[57] ABSTRACT

An engine shut-down device is shown for an engine, having a magneto for generating an a.c. voltage in response to a speed of the engine, an ignition coil provided to ignite the engine, a driver responsive to the a.c. voltage for driving the ignition coil, and generator for generating an engine-stop signal. The device includes a trigger responsive to the engine-stop signal for flowing a forward current from magneto to a ground when the magneto produces a positive value of the a.c. voltage and a backward current for a predetermined period of time from the ground to the magneto when the magneto produces a negative value of the a.c. voltage, an engine-stop section responsive to the backward current for flowing a short-circuit current from ground to the magneto to disoperate the ignition coil, so as to stop the engine.

12 Claims, 5 Drawing Sheets

ENGINE SHUT-DOWN DEVICE

This invention relates to a shut-down device for an engine, and more particularly relates to a device for stopping an engine by subjecting a magneto to be short-circuited.

In general, an industrial engine has a magneto used for producing an ignition voltage to a primary side of an ignition coil. The engine is forcibly stopped in such a way that the primary side of the ignition coil is short-circuited by means of an engine-stop circuit having an engine-stop thyristor so as not to induce an insulation breakdown voltage across a secondary side of the ignition coil, as disclosed in Japanese Utility Model Application Nos. 53(1978)-143933 and -71129.

The engine-stop circuit is composed of the thyristor provided in parallel to the primary side of the ignition coil, a capacitor connected across the magneto and a gate of the thyristor and a switch connected across the gate and a ground.

The capacitor is charged and a gate current flows through the gate to turn on the thyristor by turning on the switch while the thyristor is applied with the ignition voltage in a forward direction.

The ignition coil is thus short-circuited and a current which is to flow through the primary side is discharged through the thyristor. A portion of the current is then charged by the capacitor.

Next, the thyristor is applied with the ignition voltage in reverse direction when the polarity of the ignition voltage is reversed. A current discharged from the capacitor flows through the gate to turn on the thyristor. Therefore, the thyristor continues to be turned on.

However, a capacitor with such as 100 μF should be employed as that capacitor in order to continuously turn on the thyristor until the engine completely stops. The capacitor with such large capacitance is expensive and requires larger space to be installed in the engine-stop circuit.

In a case that a control circuit applies a stop signal to the gate of the thyristor instead of a switch, a voltage applied to the capacitor may exceed a rated voltage of the capacitor, since this voltage is obtained by adding the negative maximum ignition voltage to a voltage of the stop signal.

Consequently, the conventional engine shut-down device in which the ignition voltage is short-circuited by means of the thyristor has a difficulty in connection to the control circuit to generate the signal to stop the engine. Furthermore, to be adapted to the signal from the control circuit, the engine-stop circuit becomes complex with many component parts so that this causes cost-up in production.

The industrial engine is often operated for a long time without an operator. Such as burning occurs to obstruct ordinary operation when the engine is short of lubricating oil or coolant while running.

There have been proposed several devices for stopping the engine when the quantity of lubricating oil or coolant becomes smaller than a predetermined amount.

An example of such device is disclosed in Japanese Utility Model Laid-Open No. 53(1978)-71129. In the device, a minute voltage is generated from a magneto through a voltage stabilizing circuit. The device has a switch to be operated when an engine is short of lubricating oil. When the switch is operated, the minute voltage is short-circuited to lower a primary-side voltage of an ignition coil below a threshold value to ignite and this state is maintained for a specific period of time.

The resistance of the switch such as a reed switch on the market is generally large with respect to a minute current generated from the magneto. Further, dirt such as carbon is accumulated on contacts of the switch. Therefore, the contacts of the switch thus does not conduct the minute current even if the switch is in on state so that the shortage of the lubricating oil cannot be detected. For that reason, a battery or a generator has been required.

A detection switch with better conduction must be adopted in order to accurately detect the shortage of the lubricating oil by means of the minute current. As a result, a cost of producing such device is becoming higher.

SUMMARY OF THE INVENTION

An object of the invention is to provide an engine shut-down device in which connection to other circuits is easily performed and a capacitor for continuously turning on an engine-stop thyristor having less capacitance.

Another object of the present invention is to provide an engine shut-down device to accurately detect the quantity of such as lubricating oil or coolant without an expensive detection switch to prevent a cost of producing the device becoming higher and to always compensate high detection accuracy.

There is provided an engine shut-down device of an engine, having a magneto for generating an a.c. voltage in response to a speed of the engine, an ignition coil provided to ignite the engine, a drive section responsive to the a.c. voltage for driving the ignition coil, and a generating section for generating an engine-stop signal, comprises, a trigger section responsive to the engine-stop signal for flowing a forward current from magneto to a ground when the magneto produces a positive value of the a.c. voltage and a backward current for a predetermined period of time from the ground to the magneto when the magneto produces a negative value of the a.c. voltage, an engine-stop section responsive to the backward current for flowing a short-circuit current from ground to the magneto to disoperate the ignition coil, so as to stop the engine.

The device further comprises a magneto for generating an a.c. voltage in response to an engine speed of the engine, an ignition coil provided to ignite the engine, a drive section responsive to the a.c. voltage for driving the ignition coil, a diaphragm-type pressure switch having movable and fixed contacts for detecting shortage of lubricating oil or coolant and generating a detection signal by way of the operation of the contacts, a signal generation section for generating an engine-stop signal after the detection signal continues to be generated for a predetermined period of time, an engine stop section for subjecting the a.c. voltage applied to the ignition coil below a predetermined ignition threshold value when the engine-stop signal is applied thereto, a section for converting the a.c. voltage generated by the magneto to a d.c. voltage, and a refresh section for refreshing the contacts by applying a refresh current across the contacts when the engine ordinarily stops.

The other objects and features of this invention will become understood from the following description with reference to the accompanying drawing.

DETAILED DESCRIPTION OF THE PREFERRED EMBODIMENTS

Figure 1:
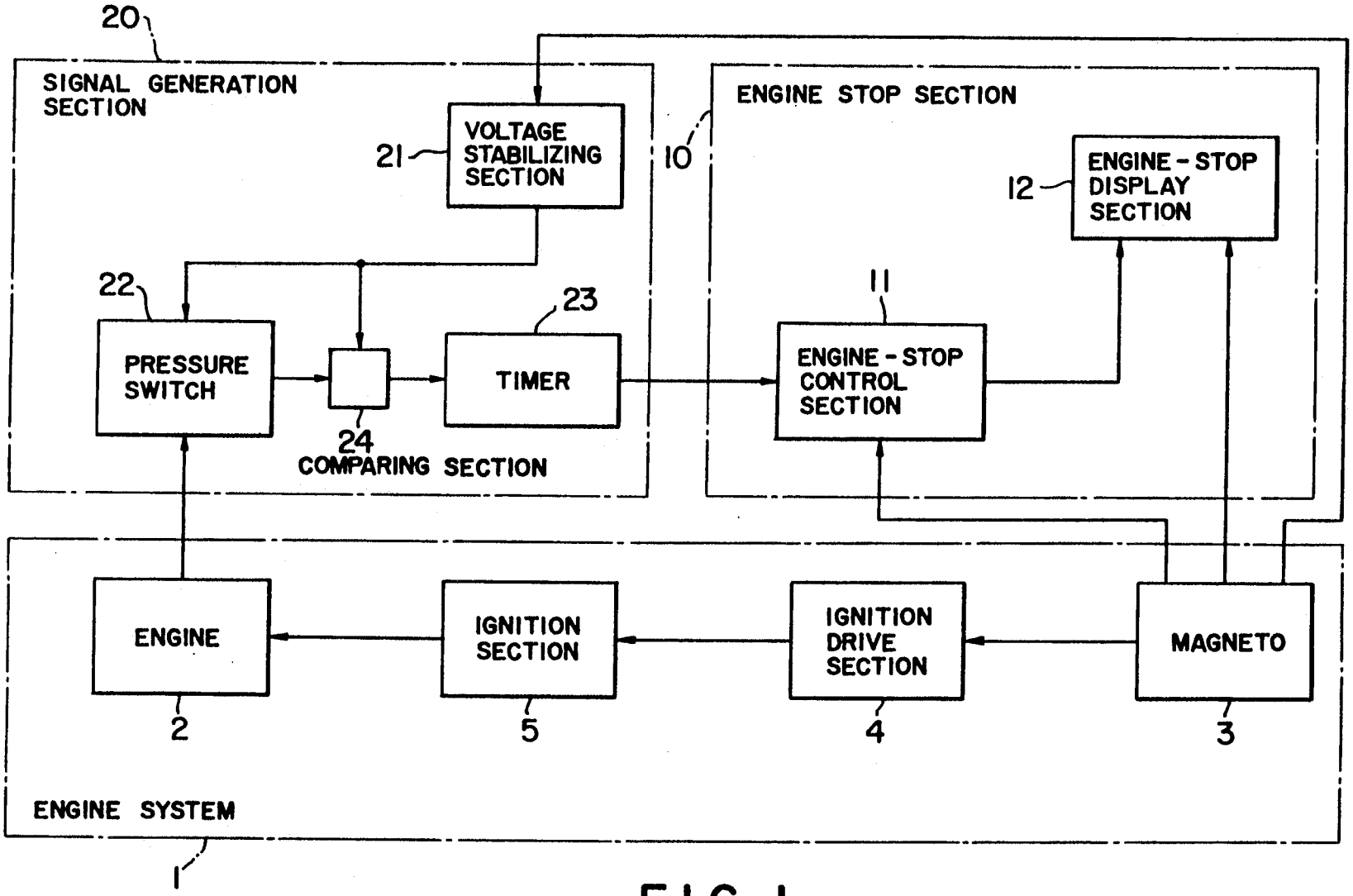
FIG. 1 is a block diagram showing a basic configuration of a preferred embodiment according to the present invention.

The preferred embodiments according to the present invention will be explained in detail with reference to the accompanying drawings.

Throughout the drawings, like reference numerals and letters are used to designate like or equivalent elements for the sake of simplicity of explanation.

FIG. 1 is a block diagram showing a basic configuration of a preferred embodiment of an engine shut-down device according to the present invention. The engine shut-down device is composed of an engine system 1, an engine stop section 10 and a signal generation section 20.

The engine system 1 comprises a magneto 3, an ignition drive section 4, an ignition section 5 and an engine 2. The engine stop section 10 comprises an engine-stop control section 11 and an engine-stop display section 12. And the signal generation section 20 comprises a voltage stabilizing section 21, a pressure switch 22, a comparing section 24 and a timer 23.

The magneto 3 feeds an a.c. voltage Vc to the ignition drive section 4, the ignition section 5, the engine-stop control section 11, the engine-stop display section 12 and the voltage stabilizing section 21 which feeds a stabilized d.c. voltage to the pressure switch 22 and the comparing section 24.

Figure 2:
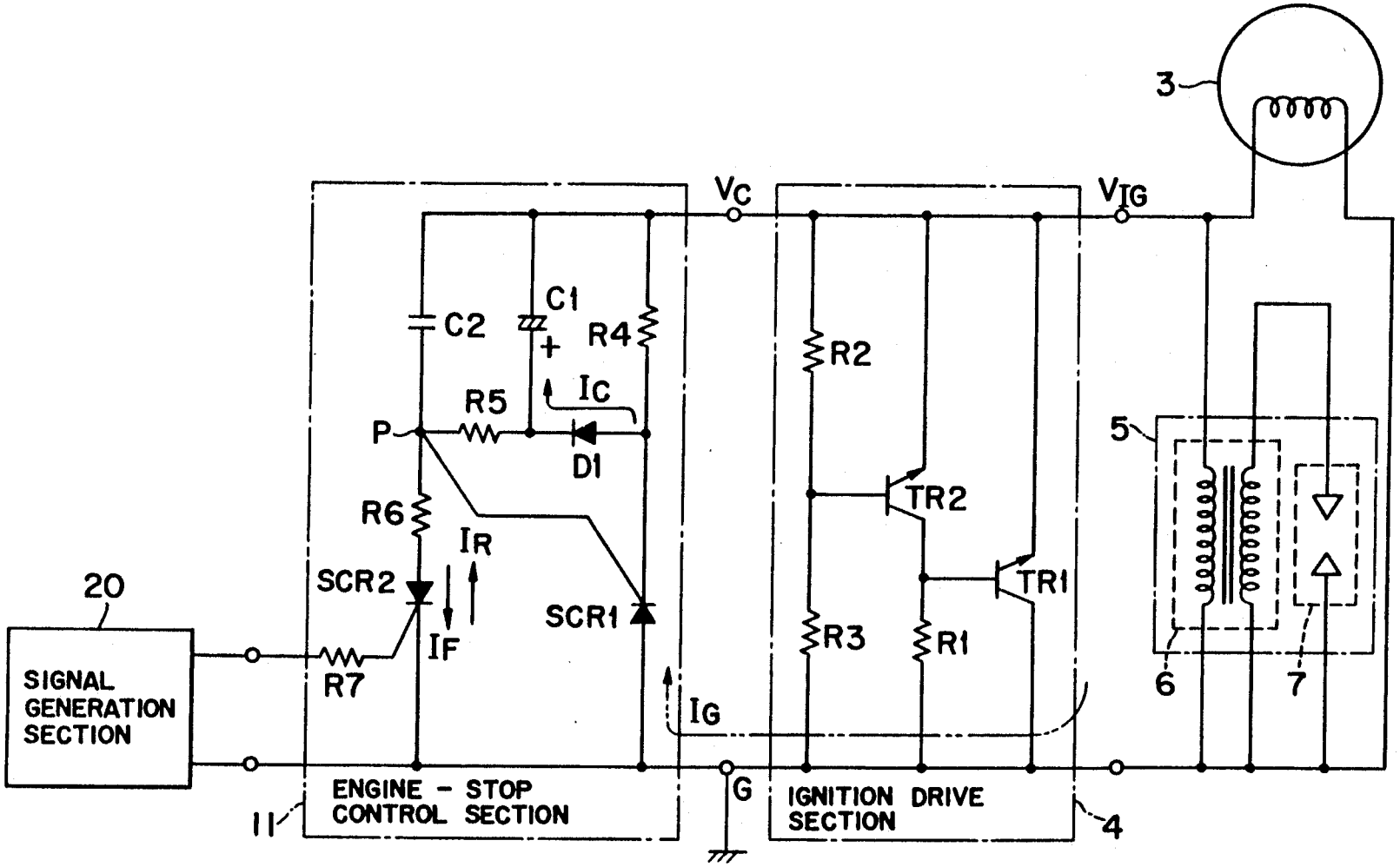
FIG. 2 shows a circuit diagram of the preferred embodiment according to the present invention.

FIG. 2 shows a detailed circuit of the engine shut-down device according to the present invention.

In FIG. 2, an ignition plug 7 is connected across an ignition coil 6 at the secondary side thereof provided in the ignition section 5. A terminal of a primary side of the ignition coil 6 is connected to the magneto 3, the other terminal of the ignition coil 6 being connected to a ground G.

Both emitters of NPN-type transistors Tr1 and Tr2 are connected together to the terminal of the primary side of the ignition coil 6 connected to the magneto 3. A collector of the transistor Tr1 is connected to the other terminal of the primary side of the ignition coil 6 connected to the ground G. A collector of the transistor Tr2 is connected to the other terminal of the primary side of the ignition coil 6 connected to the ground G through a resistor R1.

A base of the transistor Tr1 is connected between the collector of the transistor Tr2 and the resistor R1. A base of the transistor Tr2 is connected between resistors R2 and R3 connected in series each other across the magneto 3 and the ground G.

A cathode of an engine-stop thyristor SCR1 provided in the engine-stop control section 11 is connected to the magneto 3 through a resistor R4. An anode of the thyristor SCR1 is connected to the ground G.

A plus terminal of an electrolysis capacitor C1 is connected between a cathode of a diode D1 and a resistor R5, the other terminal of the capacitor C1 being connected to the magneto 3.

An anode of a trigger thyristor SCR2 is connected to the magneto 3 through a resistor R6 and a capacitor C2. A cathode of the thyristor SCR2 is connected to the ground G. A gate of the thyristor SCR1 is connected to a point P provided between the capacitor C2 and the resistor R6.

A cathode of the diode D1 whose anode is connected between the resistor R4 and cathode of the thyristor SCR1 is connected to the point P through a resistor R5.

The ignition drive section 4 is connected to the engine-stop control section 11 which is connected to the signal generation section 20. An engine-stop signal is applied to the engine-stop control section 11 from the signal generation section 20 to forcibly stop the engine 2. The engine-stop signal may be applied from a manual switch other than the signal generation section 20.

Figure 5:
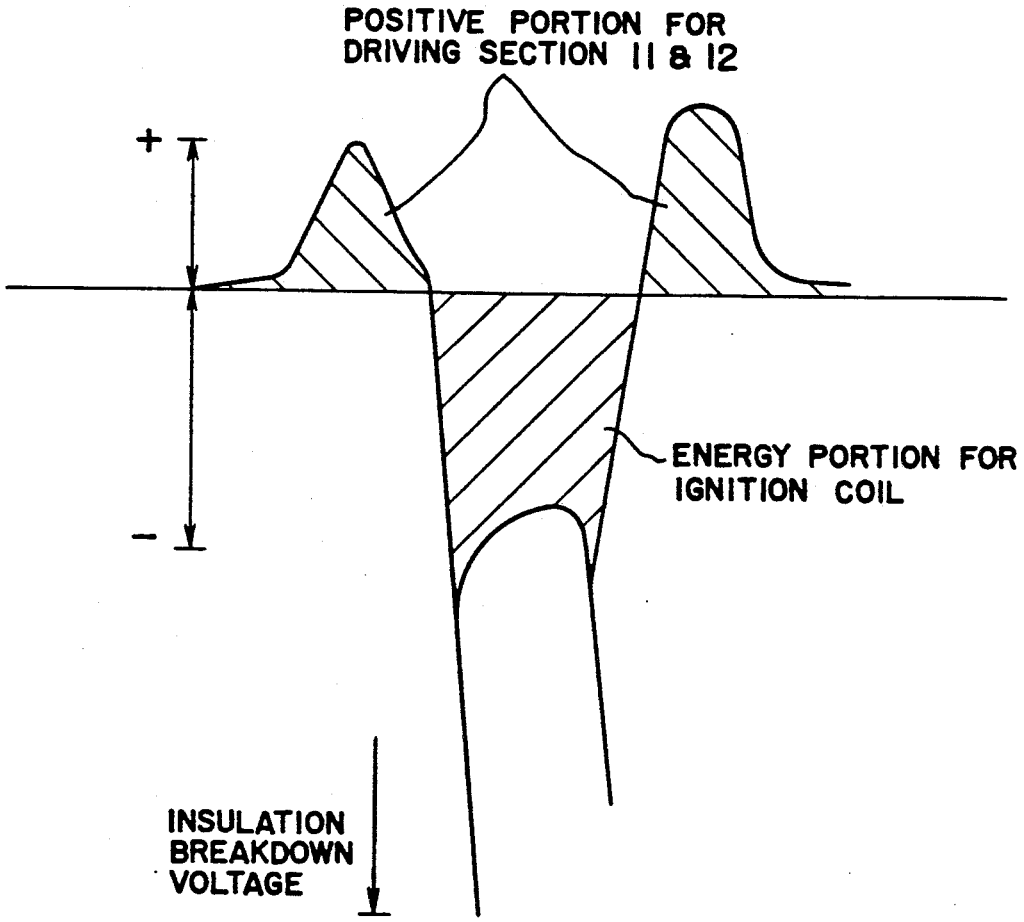
FIG. 5 shows a waveform of an ignition voltage.

When the engine 2 is running, the a.c. voltage Vc depicted in FIG. 5 is applied to the ignition drive section 4 and the engine-stop control section 11. Under the state, when a voltage (the engine-stop signal) is applied to the gate of the thyristor SCR2 through a resistor 7 from the signal generation section 20, a turn-on current thus flows through the gate to turn on the thyristor SCR2. A forward current IF then flows through the thyristor SCR2 through the diode D1 and the resistors R5 and R6 when a potential Vc is higher than a ground level VG ($Vc > VG$).

On the other hand, the anode and the cathode of the thyristor SCR2 is then biassed in reverse direction to turn off the thyristor SCR2 when the potential Vc becomes lower than the ground level VG. A recovery current IR flows through the thyristor SCR2 and charges the capacitors C1 and C2 so as to feed a voltage to the gate of the thyristor SCR1 in forward direction.

Figure 3:
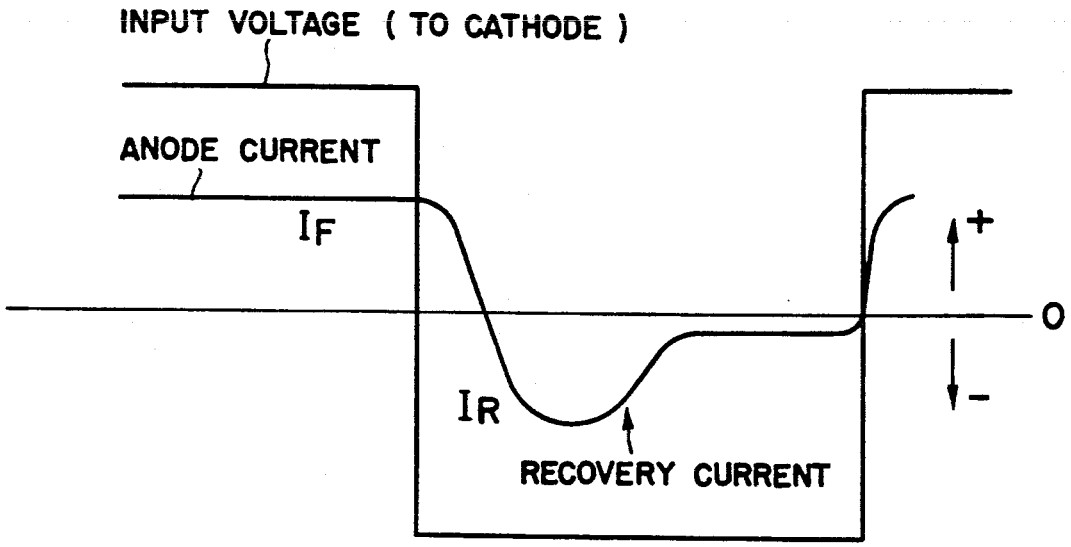
FIGS. 3 and 4 show characteristics of a thyristor used in the preferred embodiment according to the present invention.

This recovery current IR is to recover the reverse-blocking state of the thyristor SCR2. FIG. 3 shows the recovery current IR against a square wave form input voltage. The thyristor SCR2 having longer recovery duration should be used for effective flow of the recovery current IR.

The thyristor SCR1 is then turned on when a potential of the point P that is the voltage of the gate of the thyristor SCR1 reaches a turn-on voltage. A current IG' flows through the thyristor SCR1 in forward direction during $Vc < VG$ to disable the transistor TR1 to cut off the primary side of the ignition coil 6.

Once the thyristor SCR1 is turned on, a charge current Ic flows from the ground G through the thyristor SCR1 and the diode D1 to charge the capacitor C1. Therefore, after that, the potential of the point P increases to enable the thyristor SCR1 to be turned on due to discharge of the capacitor C1 with a time constant determined by the resistor R5 and the capacitor C1 when $Vc < VG$. As a result, once the thyristor SCR1 is turned on, the thyristor SCR1 repeats to be turned on and off to completely stop the engine without respect to the thyristor SCR2 being turned on and off or the engine stop signal.

The recovery current IR of the thyristor SCR2 is added to the discharge current flowing from the capacitor C1 to be applied to the gate of the thyristor SCR1 when the engine stop signal is continuously applied to the thyristor SCR2 to be turned on and off. Thus, the capacitance of the capacitor C1 may be about 10 $\mu$F compared to conventional device required to have 100 μF. This results in the device made compact.

The resistors R5 and R6 should be properly adjusted to turn on the thyristor SCR1. The resistor R5 is then adjusted to determine the time constant (R5×C1) of the capacitor C1 so as to rapidly increase the voltage of the gate of the thyristor SCR1.

Figure 4:
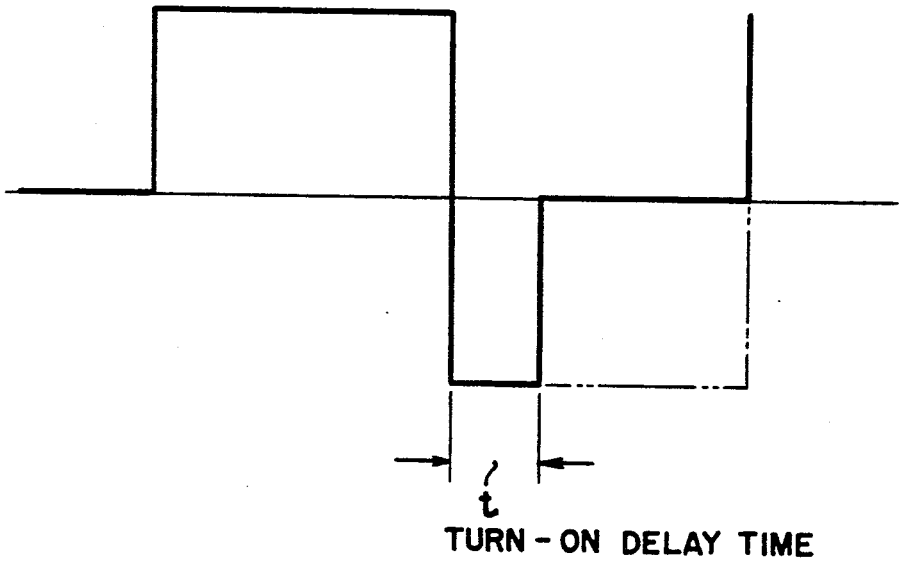

The resistor R5 and the capacitor C2 are properly adjusted to compensate a delay time t of the gate voltage of the thyristor SCR1 to be turned on due to the time constant (R5×C2) of the capacitor C2 as shown in FIG. 4.

The resistor R6 is further properly adjusted to compensate a time to charge the capacitors C1 and C2 by the recovery current IR of the thyristor SCR2.

The process described above is performed at about 2 ms with respect to one period of the voltage Vc depicted in FIG. 2.

The waveform of the voltage Vc applied to the primary side of the ignition coil 4 is depicted in FIG. 5 in detail. In FIG. 5, the positive portion of the waveform is used to drive the sections 11 and 12. While, the negative portion of the waveform is used to generate a voltage about 400 V at the primary side of the ignition coil 6 by cutting off the transistor TR1.

As is already described, the thyristor SCR2 is first turned on and the thyristor SCR1 follows SCR2 when the engine stop signal is applied to the engine-stop control section 11. The magneto 3 is shorted to be grounded. The ignition energy required for ignite the ignition coil 6 at the primary side of the ignition coil 6 is consumed by the resistor R4 and capacitor C1 to completely stop the engine 2.

Another preferred embodiment of the engine shutdown device according to the present invention will be explained with reference to FIG. 6.

Figure 6:
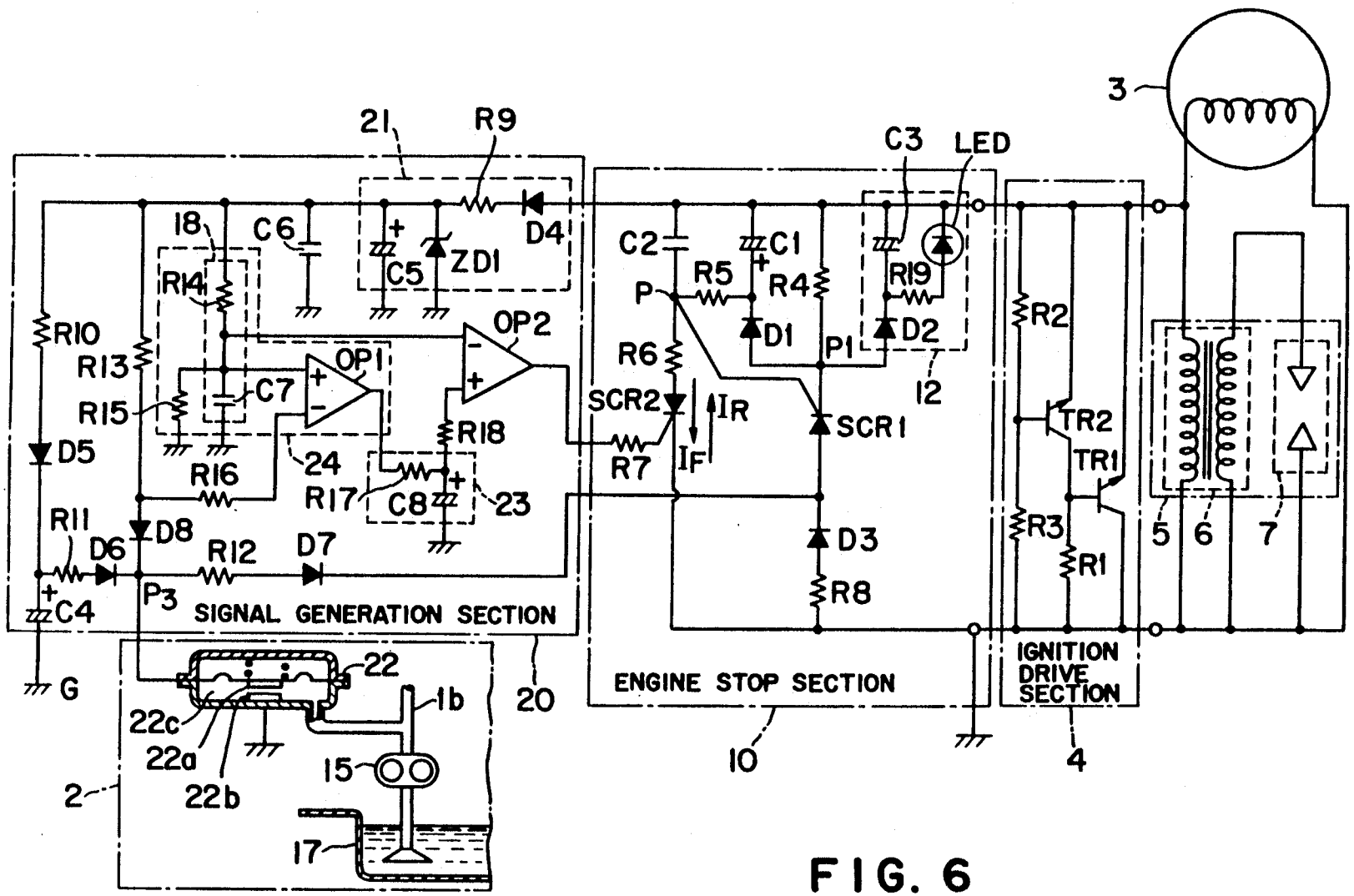
FIG. 6 shows a circuit diagram of another preferred embodiment according to the present invention.

The apparatus shown in FIG. 6 is composed of the ignition section 5, the ignition drive section 4, the engine stop section 10 and the control section 20.

There is further provided the engine-stop display section 12 in the engine stop section 10. In the engine-stop display section 12, an anode of a diode D2 is connected to a point Pl provided between the resistor R4 and the cathode of the thyristor SCR1. A cathode of the diode D2 is connected, through a resistor R19, to an anode of a light emitting diode LED which cathode is connected to the magneto 3. A capacitor C3 is connected to the cathode of the diode D2 in parallel to the light emitting diode LED and the resistor R19. A diode D3 and a resistor R8 are connected between the anode of the thyristor SCR1 and the ground G.

There is still further provided voltage stabilizing section 21 in the signal generation section 20. In the voltage stabilizing section 21, an anode of a diode D4 is connected to the magneto 3. A cathode of the diode D4 is connected to an anode of a diode D5 through resistors R9 and R10. A cathode of the diode D5 is connected to the ground G through a capacitor C4.

An anode of a Zener diode ZD1 in the voltage stabilizing section 21 is connected to the ground G. A cathode of the Zener diode ZD1 and a plus terminal of an electrolytic capacitor C5 which other terminal is connected to the ground G are connected in parallel each other between the resistors R9 and R10.

A terminal of a capacitor C6 is connected between the resistors R9 and R10 and the other terminal of the capacitor C6 is connected to the ground G.

An anode of a diode D6 is connected between the cathode of the diode D5 and the capacitor C4 through a resistor 11. A cathode of the diode D6 is connected to an anode of a diode D7 through a resistor R12. A cathode of the diode D7 is connected between the cathode of the diode D3 and the anode of the thyristor SCR1.

A cathode of a diode D8 is connected to a point P3 provided between the diode D6 and the resistor R12. An anode of the diode D8 is connected between the resistors R9 and R10 through a resistor R13.

A movable contact 22*a* of a diaphragm-type pressure switch 22 which is an example of a detection switch is connected to the point P3 and a fixed contact 22*b* of the diaphragm-type pressure switch 22 is connected to the ground G.

The contacts 22*a* and 22*b* of the pressure switch 22 are provided in a pressure chamber 22*c* as detachably facing each other. The pressure chamber 22*c* is communicated with an oil passage 16 provided at an outlet of an oil pump 15. An inlet of the oil pump 15 is exposed to the bottom of an oil pan 17.

The comparing section 24 comprises resistors R14 and R15, a capacitor C7 and a comparator OP1. A terminal of the resistor R14 is connected between the resistors R9 and R10 and the other terminal of the resistor R14 is connected, in series, to a resistor R15 which is connected to the ground G.

A non-inverting input terminal of the comparator OP1 and the capacitor 7 are connected together to a point P4 provided between the resistors R14 and R15. The capacitor 7 and the resistor R14 constitute a delay circuit 18. A reference voltage is applied to the non-inverting input terminal of the comparator OP1.

An inverting input terminal of the comparator OP1 is connected between the resistor R13 and the anode of the diode D8 through a resistor R16.

An output terminal of the comparator OP1 is connected to a non-inverting input terminal of a comparator OP2 through resistors R17 and R18. An inverting input terminal of the comparator OP2 is connected between the resistors R14 and R15 to be applied with the reference voltage. An output terminal of the comparator OP2 is connected to a gate of the thyristor SCR2 of the engine stop section 2.

A terminal of an electrolytic capacitor C8 which other terminal is connected to the ground G is connected between the resistors R17 and R18. The resistor R17 and the capacitor C8 constitute the timer 23.

Operation of the preferred embodiment according to the present invention constituted as above will be explained.

Engine start

While the engine 2 stops, the oil pump 15 is not operated so that the contacts 22*a* and 22*b* of the diaphragm-type pressure switch 22 touch with each other.

Then the engine 2 starts, the oil pump 15 is operated to pump up lubricating oil preserved in the oil pan 17 and a voltage Vc which waveform is shown in FIG. 5 is generated from the magneto 3 synchronizing with an engine speed.

Oil pressure of the lubricating oil applied to the pressure chamber 22*c* of the pressure switch 22 is low when the engine 2 starts and the contacts 22*a* and 22*b* still touch with each other.

This results in a signal "L" (low level) fed to the non-inverting input terminal of the comparator OP1 of the comparing section 24 in the signal generation section 20. However, transition of the reference voltage applied to the non-inverting input terminal of the comparator OP1 is delayed by the delay circuit 18 so that the comparator OP1 generates the signal "L".

The signal "L" is then fed to the non-inverting input terminal of the comparator OP2 so that the output terminal of the comparator OP2 feeds the gate of the thyristor SCR2 of the engine stop section 10 with the signal "L". This results in the thyristor SCR2 being in "OFF"-state.

Ordinary driving

Oil pressure is increased to press the pressure chamber 22*c* of the pressure switch 22 when the engine 2 starts and the engine speed is gradually increased. This results in the contacts 22*a* and 22*b* separating from each other.

The voltage Vc generated from the magneto 3 synchronizing with the engine speed is applied to the comparing section 24 through the voltage stabilizing section 21.

The capacitor C7 is charged and the reference voltage decided by the resistors R14 and R15 is applied to the non-inverting input terminal of the comparator OP1. On the other hand, a signal "H" (high level) is fed to the inverting input terminal of the comparator OP1 which output terminal generates the signal "L". Thus, the signal "L" is generated from the output terminal of the comparator OP2 so that the engine stop section 10 is still not operated.

Ordinary driving to engine stop

The oil pressure of the lubricating oil applied to the pressure chamber 22*c* of the pressure switch 22 is gradually lowered to turn on the pressure switch 22 when the engine 2 stops after the ordinary driving.

A current then flows the contacts 22*a* and 22*b* of the pressure switch 22 through the resistor R11 and the diode D6 from the capacitor C4 charged when the engine 2 is ordinarily driven. This results in a discharge occurring across the contacts 22*a* and 22*b* to be cleaned. The contacts 22*a* and 22*b* are thus refreshed.

Shortage of the lubricating oil

The oil pressure of the lubricating oil is lowered when the quantity of the lubricating oil preserved in the oil pan 17 becomes smaller than the predetermined amount. This results in the contacts 22*a* and 22*b* of the pressure switch 22 starting chattering.

The signal "L" is fed to the inverting input terminal of the comparator OP1 which output terminal generates the signal "H" when the contacts 22*a* and 22*b* touch with each other. Therefore, the comparator OP1 alternately generates the signals "H" and "L" correspondingly with the chattering of the pressure switch 22. The alternately generated signals "H" and "L" are then fed to the timer 23 composed of the resistor R17 and the capacitor C8. The timer 23 generates "H" signal when a predetermined time is elapsed after inputting the signal "H" from the comparator OP1. Therefore, the comparator OP2 does not generate "H" signal to operate the engine stop section during the chattering of the pressure switch 22.

The signal "H" is generated from the output terminal of the comparator OP2 when the pressure switch 22 is still in "ON"-state during the predetermined time and the voltage applied to the non-inverting input terminal of the comparator OP2 from the timer 23 becomes higher than the reference voltage. This results in the thyristor SCR2 being turned on.

When the thyristor SCR2 is turned on, the forward current flows through the resistor R4, the diode D1 and the resistors R5 and R6 if the potential Vc is higher than the ground level VG ($Vc > VG$), whereas the recovery current flows the thyristor SCR2 to charge the capacitors C2 and C1 if the potential Vc is lower than the ground G ($Vc < VG$).

The thyristor SCR1 is then turned on when the discharge voltage from the capacitor C1 reaches the turn-on voltage of the gate of the thyristor SCR1. The voltage applied to the primary side of the ignition coil 6 is short-circuited through the resistor R8 and the diode D3 and becomes lower than the ignition threshold value to extinguish the ignition coil 6 during $Vc < VG$.

A charge current to charge the capacitor C3 flows from the thyristor SCR1, when the thyristor SCR1 is turned on. As a result, the thyristor SCR1 is turned on by the discharge current from the capacitor C1 without respect to the "ON/OFF"-state of the thyristor SCR2. The voltage applied to the primary side of the ignition coil 6 of the ignition section 5 is thus held below an ignition threshold value until the engine 2 stops.

When the thyristor SCR1 is turned on, a short-circuit current ($Ia + Im$) which is the composite current of a current Ia from the pressure switch 22 side and a current Im from the resistor R8 and the diode D3 side flows the thyristor SCR1.

The capacitor C3 of the engine-stop display section 12 is charged by the short-circuit current and the light emitting diode LED is turned on.

The magnitude of the current Ia flowing from the pressure switch 22 side is determined by a shunt ratio of the resistors R5 and R12. According to an experiment, the short-circuit current is about 3 A. A current larger than a required minimum current 100 mA can be fed to the pressure switch 22 even concerning with the shunt ratio. A guarantee current for refreshing the pressure switch 22 is thus satisfied.

As is described from the foregoing, in the engine shut-down device according to the present invention, the anode of the engine-stop thyristor and the cathode of the trigger thyristor are grounded together and the engine-stop signal is applied to the gate of the trigger thyristor. Accordingly, the voltage of the engine-stop signal does not influence to the engine-stop control section so as to easily connect the signal generation section which generates the engine-stop signal to the engine-stop control section. Therefore, circuit configuration is simplified and the cost for production is reduced.

There is further provided the capacitor connected to the anode of the trigger thyristor and the gate of the engine-stop thyristor, which is charged with recovery current of the trigger thyristor and further charged when the engine-stop thyristor is turned on. The engine-stop thyristor is therefore turned on based on the discharge current from the capacitor and the recovery current. This results in the capacitor with small capacitance to be used. Thus, the device is made compact.

Furthermore, there is provided the refresh means to clean the switch for detecting the quantity of the lubricating oil. Therefore, an expensive detection switch is not needed and high detection accuracy is always assured.

While the presently preferred embodiments of the present invention has been shown and described, it is to be understood that the disclosures are for the purpose of illustration and that various changes and modifications may be made without departing from the scope of the invention as set forth in the appended claims.

What is claimed is:

1. An engine shut-down device of an engine, having a magneto for generating an a.c. voltage in response to engine speed, an ignition coil provided to ignite the engine, drive means responsive to the a.c. voltage for driving the ignition coil, and generating means for generating an engine-stop signal, comprising:

trigger means provided with a first thyristor including a gate connected to said generating means, an anode operatively connected to said magneto and a cathode connected to a ground, and being responsive to said engine-stop signal for flowing a forward current from said magneto to the ground when said magneto produces a positive value of the a.c. voltage and a backward current for a predetermined period of time from the ground to said magneto when said magneto produced a negative value of the a.c. voltage;

engine-stop means provided with a second thyristor including a gate connected to the anode of said first thyristor, an anode connected to the ground and a cathode connected to said magneto, and being responsive to said backward current for flowing a short-circuit current from ground to said magneto to interrupt operation of said ignition coil, so as to stop the engine; and charging and discharging means responsive to said short-circuit current for charging a current and for discharging the charged current to said engine-stop means, so that said engine-stop means enables the flow of short-circuit current without said backward current.

2. The engine shut-down device according to claim 1 wherein the charging and discharging means has a capacitor connected between the anode of the first thyristor and the magneto, a diode connected between the cathode of the second thyristor and the capacitor to allow the short-circuit current to flow into the capacitor and a resistor connected between the capacitor and the gate of the second thyristor to enable to apply the current discharged from the capacitor to the gate of the second thyristor.

3. The engine shut-down device according to claim 1 wherein the signal generation means includes a diaphragm-type pressure switch having movable and fixed contacts for detecting shortage of lubricating oil or coolant and generating a detection signal by way of the operation of said contacts.

4. The engine shut-down device according to claim 3 wherein the signal generation means includes a comparator for comparing the detection signal with a reference signal to produce an abnormal signal, and a timer provided to generate an engine-stop signal after the abnormal signal continues for a predetermined period of time.

5. The engine shut-down device according to claim 3 wherein the signal generation means includes a voltage stabilizing circuit for converting the a.c. voltage to a d.c. voltage.

6. The engine shut-down device according to claim 3 wherein the signal generation means includes a refresh circuit with a capacitor, a resistor and a diode for refreshing the contacts by charging the capacitor while the engine is running and discharging electric charges in the capacitor across the contacts through the resistor and diode when the engine ordinarily stops.

7. The engine shut-down device according to claim 6 wherein the refresh circuit includes first directional electricity-conducting means for charging the capacitor with the d.c. voltage from the voltage stabilizing circuit while the engine is running and second directional electricity-connecting means for discharging electric charges across the contacts through the resistor and diode when the engine ordinarily stops.

8. The engine shut-down device according to claim 1 further comprises engine-stop display means responsive to the short-circuit current for displaying the state that the engine stops.

9. An engine shut-down device of an engine, comprising:

a magneto for generating an a.c. voltage in response to an engine speed of the engine;

an ignition coil provided to ignite the engine;

drive means responsive to the a.c. voltage for driving the ignition coil;

a diaphragm-type pressure switch having movable and fixed contacts for detecting shortage of lubricating oil or coolant and generating a detection signal by way of the operation of the contacts;

signal generation means for generating an engine-stop signal after the detection signal continues to be generated for a predetermined period of time;

engine stop means for subjecting the a.c. voltage applied to the ignition coil below a predetermined ignition threshold value when the engine-stop signal is applied thereto;

means for converting the a.c. voltage generated by the magneto to a d.c. voltage; and refresh means for refreshing the contacts by applying a refresh current across the contacts when the engine ordinarily stops.

10. The engine shut-down device according to claim 9, wherein the refresh means includes a capacitor, a resistor and a diode, wherein the capacitor is charged by magneto while the engine is running and discharges across the contacts through the resistor and diode.

11. The engine shut-down device according to claim 10 wherein the refresh means includes first directional electricity-conducting means for charging the capacitor with the d.c. voltage from the converting means while the engine is running and second directional electricity-conducting means for discharging electric charges across the contacts through the resistor and diode when the engine ordinarily stops.

12. An engine shut-down device according to claim 10 further comprises engine-stop display means for displaying the state that the engine stops.

* * * * *